US007365720B2

(12) United States Patent
Bouwens et al.

(10) Patent No.: US 7,365,720 B2
(45) Date of Patent: Apr. 29, 2008

(54) COLOUR CALIBRATION OF EMISSIVE DISPLAY DEVICES

(75) Inventors: Luc Bouwens, Merelbeke (BE); Nele Dedene, Houthalen-Helchteren (BE); Robbie Thielemans, Nazareth (BE)

(73) Assignee: Barco N.V., Kortrijk (BE)

( * ) Notice: Subject to any disclaimer, the term of this patent is extended or adjusted under 35 U.S.C. 154(b) by 654 days.

(21) Appl. No.: 10/743,969

(22) Filed: Dec. 23, 2003

(65) Prior Publication Data

US 2005/0174309 A1 Aug. 11, 2005

(51) Int. Cl.
*G09G 3/32* (2006.01)

(52) U.S. Cl. ..... 345/83; 345/77

(58) Field of Classification Search ..... 345/55, 345/63, 75.2, 77, 98, 82, 83
See application file for complete search history.

(56) References Cited

U.S. PATENT DOCUMENTS 6,313,816 B1 11/2001 Okamoto
6,340,976 B1 * 1/2002 Oguchi et al. ..... 345/690
6,485,923 B1 11/2002 Yani et al.
6,486,923 B1 11/2002 Hara
2002/0003544 A1 1/2002 Maeshima
2003/0043088 A1 3/2003 Kwasnick

* cited by examiner

*Primary Examiner*—Amr A. Awad
*Assistant Examiner*—Steven E Holton
(74) *Attorney, Agent, or Firm*—Barnes & Thornburg LLP

(57) ABSTRACT

A calibration method for calibrating a fixed format emissive display device having a plurality of pixels is described In the display each pixel comprises at least three sub-pixels for emitting light of different real primary colours. The method comprises determining, for each real primary colour separately, a virtual target primary colour which can be reached by at least 80% of the pixels of the display, determining a colour gamut defined by the determined virtual target primary colours, and adjusting the drive currents to the sub-pixels to achieve a colour inside the determined colour gamut. A display having an extended range of colours is described, i.e. a gamut of colours that is more than the gamut provided by an n virtual primary colour based electronic multicolour display, as measured on a chromaticity diagram, for example. A color and/or brightness uniform image can be produced with this fixed format emissive display device.

19 Claims, 7 Drawing Sheets m = number of OLED tiles in the entire display wall n = number of OLED modules in one OLED tile

COLOUR CALIBRATION OF EMISSIVE DISPLAY DEVICES

TECHNICAL FIELD OF THE INVENTION

The present invention relates to emissive displays, especially fixed format emissive displays such as flat panel displays, and more particularly to a method and device for colour calibration of such displays.

BACKGROUND OF THE INVENTION

Electronic displays can use transmissive or emissive materials to generate pictures or light. Emissive materials are usually phosphorescent or electroluminescent materials. Examples are inorganic electroluminescent materials such as applied in thin film and thick film electroluminescent displays (EL-displays, for example thin film TFEL displays as manufactured by Sharp, Planar, LiteArray or iFire/Westaim). Another group is organic electroluminescent materials (such as Organic Light Emitting Diode (OLED) material) deposited in layers comprising small molecule or polymer technology or phosphorescent OLED, where the electroluminescent materials are doped with a phosphorescent material. Yet another group of materials are phosphors, commonly used in the well-established cathode ray tubes (CRT) or plasma displays (PDP) and even in emerging technologies like laser diode projection displays where a laser beam is used to excite a phosphor imbedded in a projection screen.

Two basic types of displays exist: fixed format displays which comprise a matrix or array of "cells" or "pixels" each producing or controlling light over a small area, and displays without such a fixed format, e.g. a CRT display. For fixed format, there is a relationship between a pixel of an image to be displayed and a cell of the display. Usually this is a one-to-one relationship. Each cell may be addressed and driven separately. Emissive, fixed format especially direct view displays such as Light Emitting Diode (LED), Field-Emission (FED), Plasma, EL, OLED and Polymeric Light Emitting Diode (PLED) displays have been used in situations where conventional CRT displays are too bulky and/or heavy and provide an alternative to non-emissive displays such as Liquid Crystal displays (LCD). Fixed format means that the displays comprise an array of light emitting cells or pixel structures that are individually addressable, rather than using a scanning electron beam as in a CRT. Fixed format relates to pixelation of the display as well as to the fact that individual parts of the image signal are assigned to specific pixels in the display. Even in a colour CRT, the phosphor triads of the screen do not represent pixels; there is neither a requirement nor a mechanism provided, to ensure that the samples in the image in any way align with these. The term "fixed format" is not related to whether the display is extendable, e.g. via tiling, to larger arrays. Fixed format displays may include assemblies of pixel arrays, e.g. they may be tiled displays and may comprise modules made up of tiled arrays which are themselves tiled into super-modules. Thus "fixed format" does not relate to the fixed size of the array but to the fact that the display has a set of addressable pixels in an array or in groups of arrays. Making very large fixed format displays as single units manufactured on a single substrate is difficult. To solve this problem, several display units or "tiles" may be located adjacent to each other to form a larger display, i.e. multiple display element arrays are physically arranged side-by-side so that they can be viewed as a single image. Transferring image data by packetised data transmission to the various display devices makes segregation of the displayed image into tiles relatively easy.

When making colour displays, the colours are obtained through mixing light from primary colours such as, but not limited to, red (R), green (G) and blue (B). For fixed format emissive displays separate or stacked individual "primary" emitter layers generate these colours. If the primary emitter layers are applied next to each other and usually close to each other, then from a certain minimum distance onwards (compounding distance), an observer is not able to distinguish the primary emitters but sees only one resulting mixed colour. Most colour displays are bicolour or full colour, referring to respectively two primaries or at least three primary emitters per pixel.

In order to be able to generate as many colours as possible, including white, at least three primary emitters are required with the emitted wavelengths of each as close as possible to pure colours such as pure red, pure green and pure blue, for example. The theory of colour perception is well known, for example from the book "Display Interfaces", R. L. Myers, Wiley, 2002. Primaries exist as mathematical constructs only, which lie outside the range of real-world colours. A more useful colour space and colour co-ordinate system has been standardised, e.g. the CIE chromaticity diagram. Typically in fixed format displays red, green and blue pixel elements are used, typically called RGB pixel elements. A CIE chromaticity diagram with the locations thereon of typical OLED and LED materials (respectively graphs 10 and 11) is shown in FIG. 1. The locations on this diagram are shown for a typical OLED display (graph 10): red, RO; green, GO and blue, BO as well as for an LED display (graph 11): red, RL; green, GL; blue, BL.

Finally, emitters for fixed format displays have a certain emissive spectrum. Each material has a different dominant wavelength as well. This determines unambiguously what colours can be generated with a pixel.

It is known that a plurality of LEDs, and a plurality of OLEDs, show a variation in their emissive spectrum (e.g. due to fluctuation in the production process), as can be seen on FIG. 1. As the human eye is very sensitive to colour differences, colour variations between the many pixels may become perceptible, creating a distracting artefact known as "fixed pattern noise" or dithering.

In addition, in the course of differential ageing, the individual sub-pixels may change luminous efficiency and/or colour differently. If the luminous efficiency and/or colours of the sub-pixels change during ageing, and all the sub-pixels do not age in substantially the same way, a colour and/or luminance difference may also become more perceptible over time.

U.S. 2003/0443088 describes a solution to the above problem. For a given display, the colour of each sub-pixel is characterised in the factory as part of the final test before shipping. The expressed colour for each pixel is set to the smallest colour gamut for the complete population of pixels. In other words, emitted colour from each pixel is limited to the smallest colour gamut which all of the pixels of in the display can achieve.

This approach assumes substantial uniformity of the colours shown by all of the pixels of the display device. However, it sacrifices the potential colour gamut possible with a given display.

SUMMARY OF THE INVENTION

It is an object of the present invention to extend the potential colour gamut which can be addressed by substantially all pixels of a fixed format emissive display device. Preferably, a color and/or brightness uniform image is produced with this fixed format emissive display device.

In this context, a range of colours refers to the gamut of colours that can be displayed on an electronic multicolour emissive display that incorporates n, n being three or more (n>=3), virtual primary colours in order to reproduce an image. An extended range of colours refers to a gamut of colours that is more than the gamut of the n virtual primary colour based electronic multicolour display, as measured on a chromaticity diagram, for example.

The above objective is accomplished by a method and device according to the present invention.

In one aspect the present invention provides a calibration method for calibrating a fixed format emissive display device having a plurality of pixels, each pixel comprising at least three sub-pixels for emitting light of different real primary colours, the method comprising:

determining, for each real primary colour separately, a virtual target primary colour which can be reached by at least 80% of the pixels of the display, determining a colour gamut defined by the determined virtual target primary colours, and adjusting the drive currents to the sub-pixels to achieve a colour inside the determined colour gamut. Any colour within the colour filed can be reached by the at least one virtual primary or a combination of two or more of the at least one virtual primary and any real primary, e.g. a linear combination of two or more of the at least one virtual primary and any real primary. The present invention includes within its scope that target virtual primaries can be changed during the lifetime of the display. This might for example be necessary if the real primary colors have changed due to (differential) aging or other environmental effects.

The method can comprise determining the color co-ordinates of a virtual target primary colour comprises determining a centre of gravity of a cloud formed by the color co-ordinates of the corresponding real primary colours of all pixels of the display device. The color co-ordinates determined for a virtual target primary colour can differ from the centre of gravity of a cloud by up to 20%. The method may furthermore comprise determining a line of gravity of a cloud formed by the color co-ordinates of the real primary colours of all pixels of the display device corresponding to the virtual target primary colour to be determined.

The color co-ordinates of the virtual target primary colour can be chosen on the line of gravity or within a deviation of at most 20% from the line of gravity.

A target luminance for each target virtual primary is preferably determined such that all or substantially all (e.g. 80% or more) of the real primaries are able to realize the target luminance of the corresponding virtual primary. The determination of the target luminance of a virtual target primary colour may depend on the application in which the display device is to be used. The target luminance of the virtual target primaries may be selected so as to provide improved brightness uniformity or to provide a higher absolute brightness value. Determining the target luminance of the virtual target primary colours may be performed after virtual target primary colours have been determined a first time.

The method may include determining a virtual target primary colour that all the sub-pixels of the display device are able to achieve. The method may also include determining a colour gamut that all the sub-pixels of the display device are able to achieve.

Typically, a plurality of linear combinations of the virtual target primary colours are used to form the colour gamut.

The determining, for each primary colour separately, of the color co-ordinates of a virtual target primary colour, may depend on the application in which the display device is used.

The virtual target primary colours are preferably determined so as to give better results with respect to colour saturation than with respect to colour uniformity.

The virtual target primary colours may be determined so as to give better results with respect to colour uniformity than with respect to colour saturation.

The determining, for each primary colour separately, of the color coordinates of the virtual target primary colour is preferably performed after virtual target primary colours have been determined a first time.

The number of virtual target primary colours may equal the number of real primary colours.

Adjusting the drive current to the sub-pixels so as to achieve a colour inside the determined colour gamut may comprise adjusting the drive current, not only of a first real primary colour which would have a negative drive stimulus value, but also of at least one other real primary colour which has a positive drive stimulus value. Adjusting the drive currents of the first real primary colour and the at least one other real primary colour may be such that the colour to be achieved inside the determined colour gamut is projected orthogonally on a plane in a stimulus co-ordinate system, which plane is span by stimulus co-ordinates of two real primary colours which would not have a negative drive stimulus.

These and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

Figure 1:
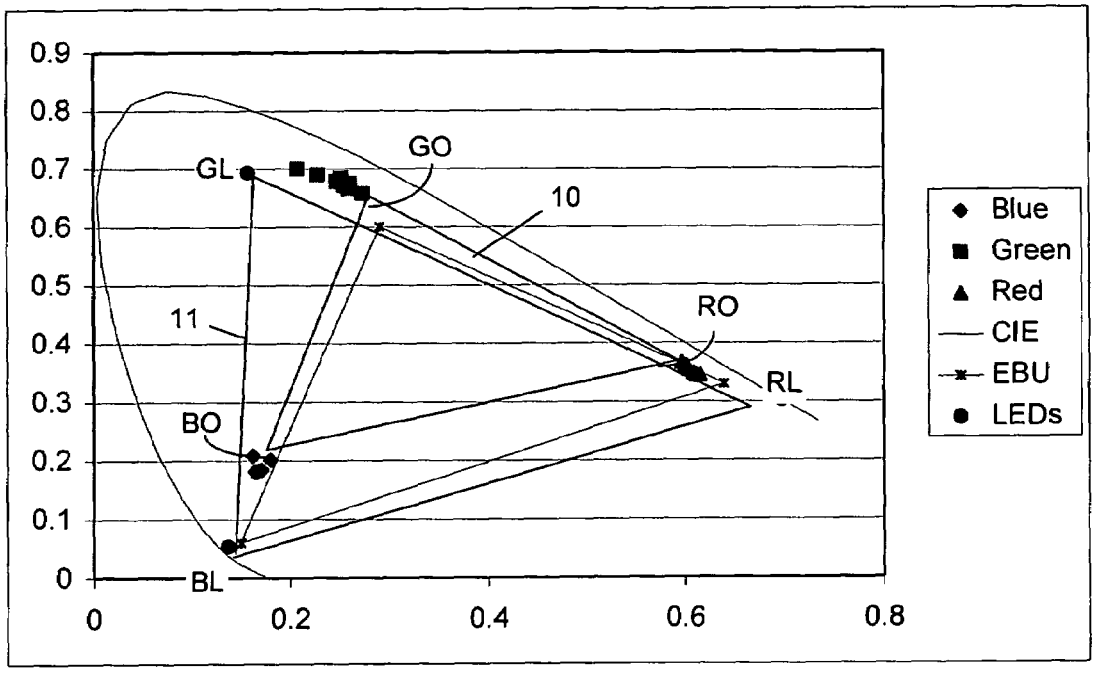
FIG. 1 shows a CIE diagram, European Broadcasting Standard, and the colour output of certain OLED and LED materials.

In the different figures, the same reference signs refer to the same or analogous elements.

DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes.

The present invention will be described with reference to an OLED display, especially a tiled OLED display, but the present invention is not limited to tiled OLED displays but may be used with any tiled or monolithic emissive display.

In the following an emissive pixel structure refers to an emissive, fixed format pixel which may comprise a number of pixel elements, e.g. red, green and blue pixel elements. Each pixel element or colour element may itself be made up of one or more sub-elements. Hence, a pixel structure may comprise sub-pixel elements. A pixel structure may be monochromatic or coloured. Further, the array may be a passive or active matrix.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

It is to be noticed that the term "comprising", used in the claims, should not be interpreted as being restricted to the means listed thereafter; it does not exclude other elements or steps. Thus, the scope of the expression "a device comprising means A and B" should not be limited to devices consisting only of components A and B. It means that with respect to the present invention, the only relevant components of the device are A and B.

Figure 2:
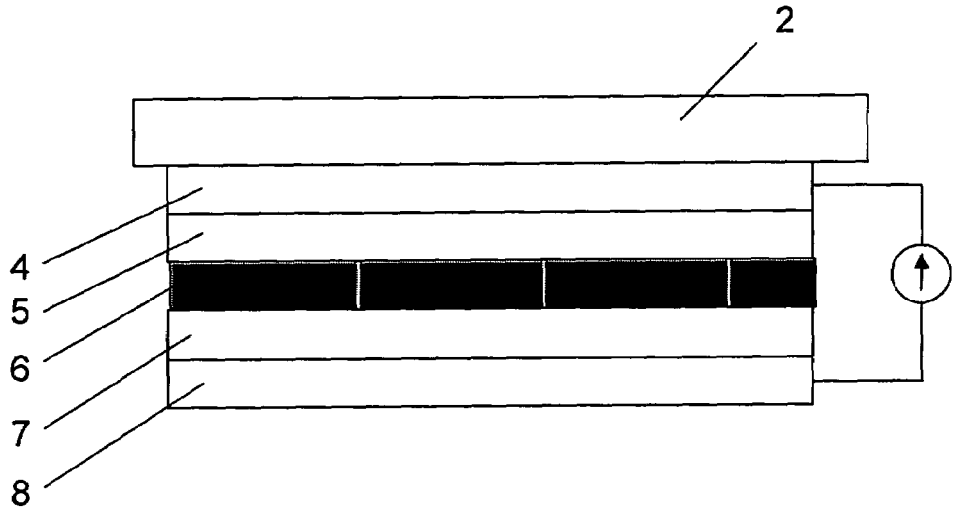
FIG. 2 illustrates a cross-section of a typical OLED pixel structure.

The traditional method of manufacture of e.g. OLED displays results in a pixel structure as shown schematically in FIG. 2 with a transparent substrate 2, usually a glass substrate, being closest to the viewer and facing in the display direction. Behind this substrate a series of layers 4-8 are deposited, e.g. at least a first transparent electrode 4, the organic light emitting element 6 and a second electrode 8. An organic light emitting material is deposited for each colour in each pixel structure, e.g. three colour elements 6, red, green and blue, for each pixel structure. Thus, each pixel structure can emit white light or any colour by controlling the light energy emitted from each colour element of a pixel structure. Usually additional layers are deposited such as electron and hole transport layers 7 and 5, respectively (see FIG. 2 that has been adapted from FIG. 4-13 of "Display Interfaces", R. L. Myers, Wiley, 2002).

Each color can be described by its tristimulus values X, Y, Z in the CIE color space. The Y value represents contributions to the brightness perception of the human eye and it is called the brightness or luminance. A color can also be described by Y and the color functions x, y, z; where $$\text{where } x = \frac{X}{X+Y+Z},\ y = \frac{Y}{X+Y+Z},\ z = \frac{Z}{X+Y+Z},\ \text{and } x+y+z=1.$$

Figure 3:
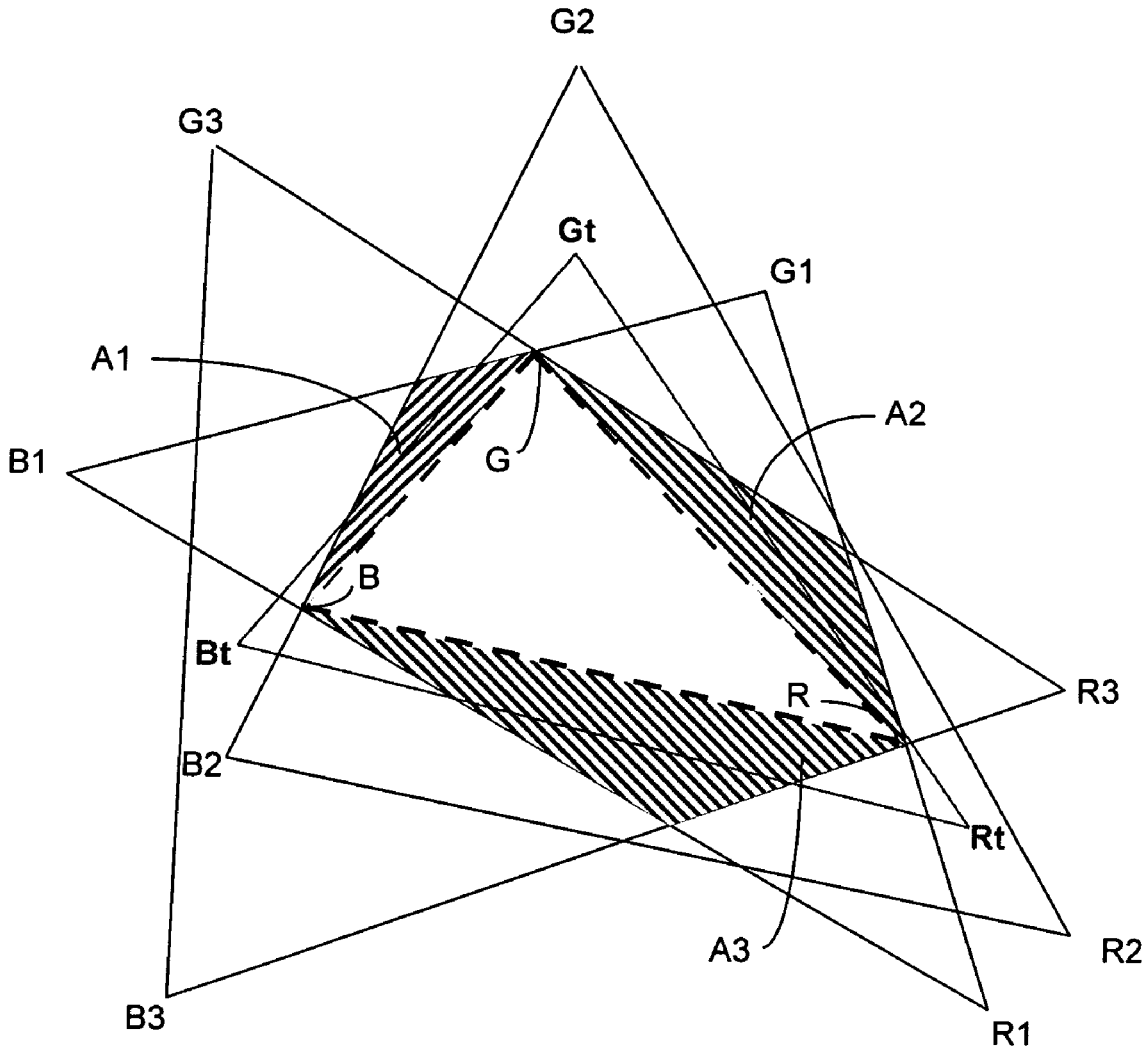
FIG. 3 diagrammatically illustrates the colour gamut of three different pixels, and the extension of the reduced colour gamut according to an embodiment of the present invention.

According to the present invention, during or after manufacturing of a light emissive fixed format display, each pixel thereof is characterised. This may e.g. be performed by measuring the colour characteristics and luminance of each pixel separately for a drive stimulus to each of the pixel elements, thus measuring the red (R), green (G) and blue (B) components of all pixels. This way, for each pixel the colour gamut becomes known. FIG. 3 illustrates for example the colour gamut of three separate pixels of an emissive fixed format display. For example a first pixel emits a red colour R1, a blue colour B1 and a green colour G1. The gamut of the first pixel is given by the triangle R1B1G1. A second pixel emits a red colour R2, a blue colour B2 and a green colour G2. The gamut of the second pixel is given by the triangle R2B2G2. A third pixel emits a red colour R3, a blue colour B3 and a green colour G3. The gamut of the third pixel is given by the triangle R3B3G3. The gamuts of these 3 pixels are plotted in the CIE colour space in FIG. 3. The x axis is the CIE x colour co-ordinate, and the y axis is the CIE y colour co-ordinate. In order to perform accurate calculations, the calculations should be based on the tristimulus values X, Y, Z or the calculations should be based on CIEx, CIEy, and Y. In other words it is important that the luminance is also taken into account. In reality a display comprises much more than three pixels, and the gamut of each of those pixels is measured. It is also possible to do the same reasoning in another colour space.

The gamut of the entire display is reduced to a gamut that can be reached by all or substantially all of the pixels of the display, for example to a gamut that can be reached by at least 80% of the pixels of the display. The term "a colour reachable by a pixel" means that there exist drive currents for the pixel elements of a pixel such that the pixel elements as a group are able to emit the specified colour. In the example given in FIG. 3, the point indicated with G is the point which gives the most saturated green colour that still can be reached by all the pixels, albeit not by operating the green sub-pixel of any of the pixels alone, but by operating a combination of the sub-pixels of a pixel. The point indicated with R gives the most saturated red that still can be reached by all the pixels, by operating a combination of their sub-pixels, and the point indicated with B gives the most saturated blue that still can be reached by all the pixels, for each of the pixels by operating a combination of its sub-pixels. One possible algorithm for calculating the points indicated with R, G, B can be to calculate lines between the colour points, and cross-points of those lines. Usually, however, one determines target colour co-ordinate values for which all the correction coefficients C (see formula 2 below) are larger than or equal to 0. Therefore, the gamut of the display can be reduced to the triangle RBG, as described in U.S. 2003/0043088. R, G and B are called the virtual primaries in the description and claims of the present invention. They are called virtual primaries since they are not real primary colours: fractional components of 2 or more real primaries of a pixel need to be combined in order to be able to make the virtual primaries R, G, and B. Fractional components of the second and third sub-pixel colours may be used to bring the colour of a first sub-pixel to a relatively smaller colour gamut that all or substantially all of the sub-pixels of that first colour can achieve. Thus, for example, red and/or blue may be used to alter the expressed colour of the green sub-pixel.

The inventor of the present invention has found that this way, the gamut of the display is reduced too much: there exist colours which fall outside the reduced gamut triangle RBG but which can still be reached by all pixels. These colours fall in colour fields which are indicated by the hatched areas A1, A2, A3 in FIG. 3. These areas are called colour fields in the remainder of the present description.

Therefore, according to the present invention, this reduced colour gamut is extended by using other target primaries than the virtual primaries R, G, B. Those other target primaries are called "virtual target primaries" or "virtual target primary colours" in the present document. The virtual target primaries are chosen in such a way that they can be reached by most pixels of the display, i.e. by at least 80% of the pixels of the display. The choice of the virtual target primaries depends on the application in which the display will be used. Depending on the application, colour saturation might be more important than colour uniformity and vice versa, leading to other choices of virtual target primaries.

Examples of virtual target primaries that could be used in the calibration algorithm of this invention are given in FIG. 3: the points indicated by Rt, Gt, and Bt. It can be seen that the colour gamut RtGtBt extends the reduced gamut RGB, and that the colours inside the new colour gamut can be reached by most pixels of the display.

Figure 4A:
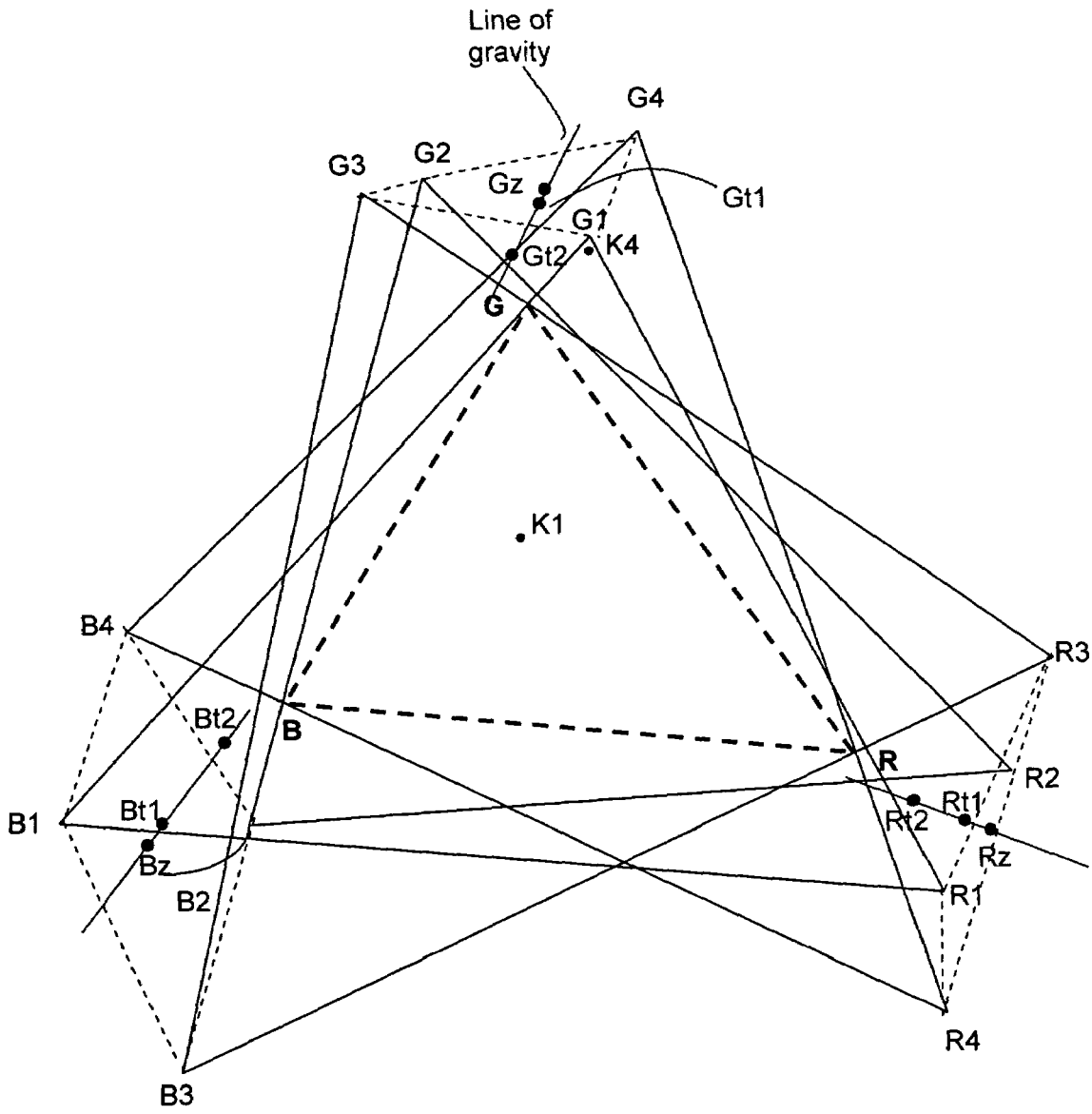
FIG. 4A diagrammatically illustrates the colour gamut of four different pixels, and the method used to extend the reduced colour gamut according to an embodiment of the present invention.

It is an advantage of the present invention that no real primaries need to be added to the pixels to extend the colour gamut. Adding real primaries to a pixel means that a pixel, instead of comprising for example three colour elements, comprises four of more colour elements, as described e.g. in WO 02/101644. Usually this is done by decreasing the size of the three existing primaries so that a fourth (or more) primary can be added within the existing active pixel area. However, e.g. in case of OLED, a reduced size of the active area of a primary colour will lead to a reduced lifetime of that colour if it is driven in the same way. The addition of a fourth (or more) colour element can also be done by keeping the same size of the first three primaries and making the pixel larger to add the fourth primary. This will lead to loss of resolution. Furthermore, adding in primaries adds to the complexity of driving circuitry for a corresponding display. The color co-ordinates of the virtual target primaries Rt, Gt, and Bt may be determined in the following way. Consider 4 pixels as shown in FIG. 4A. FIG. 4A, illustrates a CIE colour diagram with the colour gamut of four separate pixels of an emissive fixed format display. For example a first pixel emits a red colour R1, a blue colour B1 and a green colour G1. The gamut of the first pixel is given by the triangle R1B1G1. A second pixel emits a red colour R2, a blue colour B2 and a green colour G2. The gamut of the second pixel is given by the triangle R2B2G2. A third pixel emits a red colour R3, a blue colour B3 and a green colour G3. The gamut of the third pixel is given by the triangle R3B3G3. A fourth pixel emits a red colour R4, a blue colour B4 and a green colour G4. The gamut of the fourth pixel is given by the triangle R4B4G4. Again, in reality a display comprises much more than four pixels, and the gamut of each of those pixels is measured. The reduced gamut of the display, which can be reached by each and every pixel of the display, is indicated by the gamut triangle RGB. In the example given in FIG. 4A, the point indicated with G is the point which gives the most saturated green colour that still can be reached by all the pixels, the point indicated with R gives the most saturated red that still can be reached by all the pixels, and the point indicated with B gives the most saturated blue that still can be reached by all the pixels, for each of the pixels by operating a combination of their sub-pixels. The explicit calculation of the virtual primaries R, G, B is not necessary, since R, G, and B do not need to be known in order to be able to calculate the virtual target primaries. However, for clarity purposes the location of R, G, and B is shown in FIG. 4A, since this illustrates better the extension of the color gamut realized with the virtual target primaries Rt, Gt and Bt.

By defining virtual target primaries, the gamut of the entire display is extended to a gamut RtGtBt (not represented as such in the FIG. 4A) (e.g. Rt1Gt1Bt1 or Rt2Gt2Bt2, depending on the choices made for the virtual target primaries) that can be reached by substantially all of the pixels of the display.

In the example given in FIG. 4A, the point indicated with G is the point which gives the most saturated green colour that still can be reached by all the pixels, the point indicated with R gives the most saturated red that still can be reached by all the pixels, and the point indicated with B gives the most saturated blue that still can be reached by all the pixels, for each of the pixels by operating a combination of their sub-pixels. One method in accordance with an embodiment of the present invention to calculate the color co-ordinates of the virtual target primaries may be as follows. To calculate the point Gt (resp. Rt and Bt), the centre of gravity Gz (resp. Rz and Bz) of the quadrangle G1G2G3G4 (resp. R1R2R3R4 and B1B2B3B4) is first determined. Methods to determine the centre of gravity of an n-angle are known to the skilled person. The line of gravity of these quadrangles is also determined. The target virtual primaries are then chosen along or within 20% of this line of gravity. For example, the value of the CIE x and CIE y color co-ordinates of the target virtual primaries can be 20% larger or 20% smaller compared to the value of the color co-ordinates of whatever point is located on the line of gravity. If a display with a good colour saturation is desired, while colour uniformity is less important, the target virtual primaries will be chosen close to the centre of gravity, e.g. Gt1, Rt1 and Bt1 in FIG. 4A, e.g. within 20% of the centre of gravity. For example, the value of the CIE x and CIE y color co-ordinates of the target virtual primaries can be 20% larger or 20% smaller compared to the value of the color co-ordinates of the centre of gravity. If the colour uniformity of the display is very important, but the colour saturation less important, the target virtual primaries will be moved away from the centre of gravity along the line of gravity in the direction of the virtual primaries, as indicated in FIG. 4A, e.g. to the points Gt2, Rt2, and Bt2.

It should be noted that a real display usually comprises much more than 4 pixels. Therefore, the red, green and blue n-angles will in a real display rather be red, green, and blue clouds on the CIE colour diagram containing resp. the color co-ordinates of the real red, green and blue primary colours. The centre of gravity and the line of gravity of the real primary color co-ordinate clouds are then determined by performing the appropriate numerical calculations and/or approximations.

It is preferred that pixels are chosen so that the color coordinates of their real primaries fall within pre-determined boundaries. This allows to change a tile of a tiled display by another tile also comprising pixels having real primaries which fall within the pre-determined boundaries, without having to redo all calculations to obtain the extended colour gamut triangle.

Figure 4B:
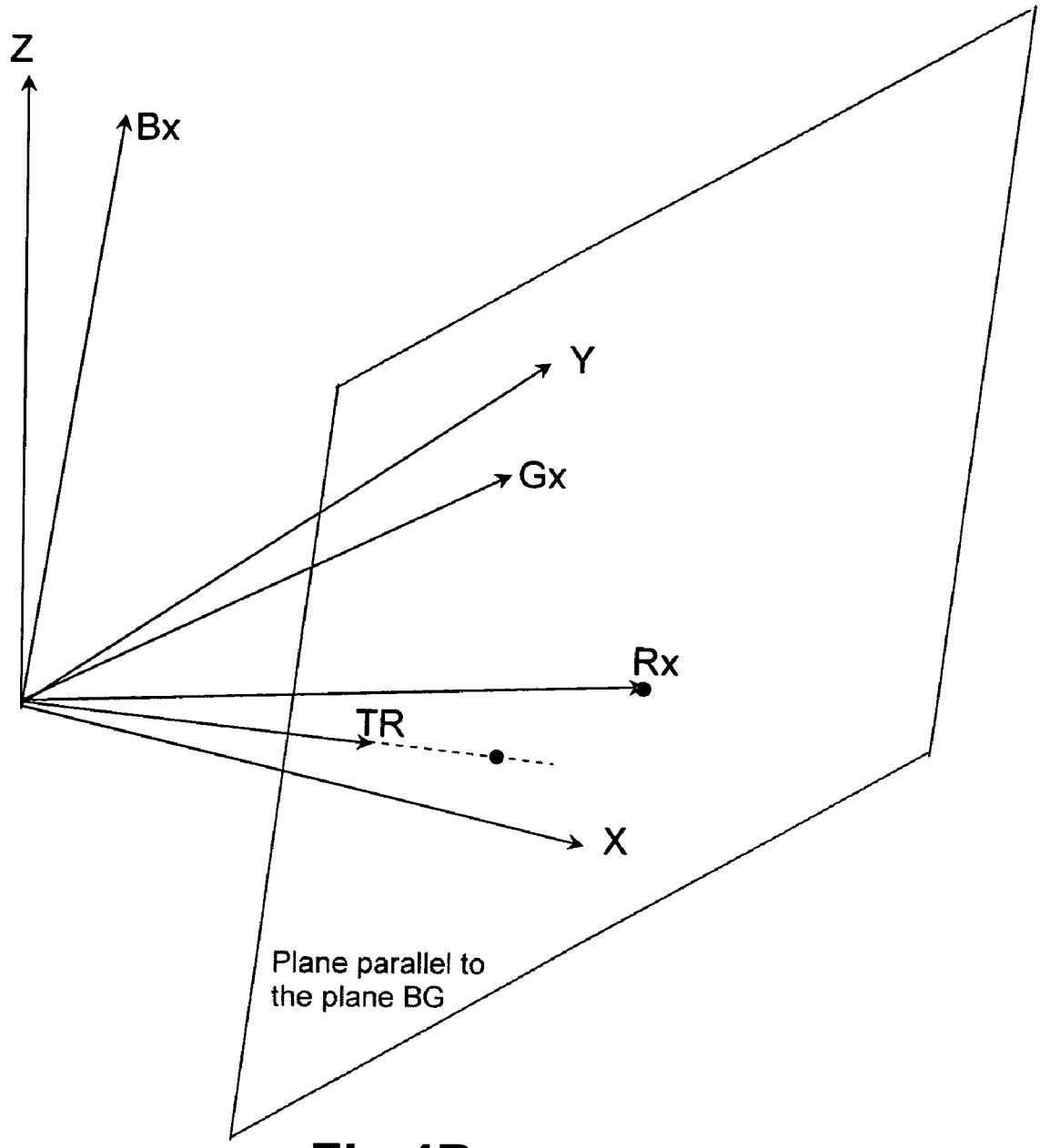
FIG. 4B diagrammatically illustrates the method used to calculate the target luminance of a target virtual primary according to an embodiment of the present invention.

One method in accordance with an embodiment of the present invention to calculate the target luminance of the virtual target primaries is illustrated in FIG. 4B. The vector TR in this figure shows the virtual target red primary. The direction of the vector TR is determined by the color co-ordinates of the virtual target primary Rt, which can be determined by the method described above. The length of this vector determines the luminance of the virtual target red primary. The target luminance is set equal to the maximal luminance that can be achieved by all are substantially all the pixels forming the display.

In order to determine this maximal achievable target luminance, the tristimulus vectors of each primary color of each pixel need to be taken into account. These tristimulus vectors are shown in FIG. 4B for one pixel of the display (i.e. pixel x) with real primary colors Rx, Gx, and Bx. The maximal achievable target luminance of the virtual target primary Rt that can be realized with this pixel x is determined by the intersection of the vector TR and the plane through the endpoint of the vector Rx and parallel to the plane formed by the vectors Bx and Gx. The same reasoning should be done for all pixels of the display. The smallest vector TR, that is determined in this way, determines the target luminance that can be realized by every pixel of the display. Depending on the application a target luminance can be determined, by selecting a length of the vector TR, that substantially all pixels of the display can achieve, e.g. 80% of the pixels of the display.

Above, it was explained how the target luminance of the red virtual target primary is determined. The target luminance of the blue and the green virtual target primaries are determined in a similar way.

Once the color coordinates and the target luminance of the virtual target primaries Rt, Gt, and Bt for a display have been determined, all colours to be represented on the display device have to be converted to drive stimuli for pixel colour elements of pixels, or thus to drive stimuli of the sub-pixels. For example, if a colour K1 (FIG. 4A) is to be represented, drive stimuli to be applied are known in function of virtual target primaries such as for example Rt1, Gt1 and Bt1, as shown in formula (1). The calculations are performed on the tri-stimulus values X, Y, and Z Tristimulus values of the color *K1* — Target tristimulus values for *Rt1*, *Gt1*, and *Bt1* — "Drive stimuli" (1)

$$\begin{pmatrix} X_{K1} \\ Y_{K1} \\ Z_{K1} \end{pmatrix} = \begin{pmatrix} X_{\text{target_R}} & X_{\text{target_G}} & X_{\text{target_B}} \\ Y_{\text{target_R}} & Y_{\text{target_G}} & Y_{\text{target_B}} \\ Z_{\text{target_R}} & Z_{\text{target_G}} & Z_{\text{target_B}} \end{pmatrix} \begin{pmatrix} A \\ B \\ C \end{pmatrix}$$

The drive stimuli for Rt1, Gt1 and Bt1 are then converted to drive stimuli for the relevant pixel, for example if the colour K1 has to be represented by the first pixel with real primaries R1, G1 and B1, then the drive stimuli for the virtual target primaries Rt1, Gt1 and Bt1 are converted to drive stimuli for the real primaries R1, G1 and B1.

This may be done as follows. The colour co-ordinates (x, y) and luminance Y, i.e. the tristimulus values X, Y, and Z, of each primary colour Rp, Gp, Bp of each pixel are known. The correction values for the red R1, green G1, and blue B1 sub-pixels to reproduce the new virtual target primary colours Rt1, Gt1, and Bt1 can be calculated as follows. The calculations should be performed on the tri-stimulus values X, Y, and Z (equation 2):

Target tristimulus values for *Rt1*, *Gt1*, and *Bt1* — Given tristimulus values for *R1*, *G1*, and *B1* — Correction values (2)

$$\begin{pmatrix} X_{\text{target_R}} & X_{\text{target_G}} & X_{\text{target_B}} \\ Y_{\text{target_R}} & Y_{\text{target_G}} & Y_{\text{target_B}} \\ Z_{\text{target_R}} & Z_{\text{target_G}} & Z_{\text{target_B}} \end{pmatrix} = \begin{pmatrix} X_{\text{Pixel_R}} & X_{\text{Pixel_G}} & X_{\text{Pixel_B}} \\ Y_{\text{Pixel_R}} & Y_{\text{Pixel_G}} & Y_{\text{Pixel_B}} \\ Z_{\text{Pixel_R}} & Z_{\text{Pixel_G}} & Z_{\text{Pixel_B}} \end{pmatrix} \cdot \begin{pmatrix} C_{1_R} & C_{4_G} & C_{7_B} \\ C_{2_R} & C_{5_G} & C_{8_B} \\ C_{3_R} & C_{6_G} & C_{9_B} \end{pmatrix}$$

By solving this set of linear equations, the correction values $C_1$ to $C_9$ can be determined. The drive stimuli for the real primaries red R1, green G1, and blue B1 in order to represent the color K1 can then be calculated by substituting the equation (2) into the equation (1), yielding equation (3):

$$\begin{pmatrix} X_{K1} \\ Y_{K1} \\ Z_{K1} \end{pmatrix} = \begin{pmatrix} X_{\text{Pixel_R}} & X_{\text{Pixel_G}} & X_{\text{Pixel_B}} \\ Y_{\text{Pixel_R}} & Y_{\text{Pixel_G}} & Y_{\text{Pixel_B}} \\ Z_{\text{Pixel_R}} & Z_{\text{Pixel_G}} & Z_{\text{Pixel_B}} \end{pmatrix} \cdot \begin{pmatrix} C_{1_R} & C_{4_G} & C_{7_B} \\ C_{2_R} & C_{5_G} & C_{8_B} \\ C_{3_R} & C_{6_G} & C_{9_B} \end{pmatrix} \begin{pmatrix} A \\ B \\ C \end{pmatrix} \quad (3)$$

According to another aspect of the present invention, if colours are to be represented which fall outside the gamut or extended gamut of the display and/or which cannot be achieved by all pixels of the display, then, according to formulas (1) to (3), negative components for the drive stimuli would have to be applied. For example, a colour K4 falls outside the gamut, even outside the extended gamut of the display (see FIG. 4A). This means that the colour K4 cannot be represented by all the pixels of the display. As can be seen in FIG. 4A, colour K4 can be represented by the first pixel (primaries R1, G1, B1) and by the fourth pixel (primaries R4, G4, B4), and cannot be represented by the second pixel (primaries R2, G2, B2) nor by the third pixel (primaries R3, G3, B3). In order to represent the colour K4 by means of the second pixel, a negative stimulus value would have to be applied to the blue component B of the pixel P2. Applying negative stimulus values, however, is physically impossible.

In the prior art, this problem is solved by setting the negative stimulus values at zero. This, however can lead to bad colours since the positive correction values will have been overestimated.

Figure 5:
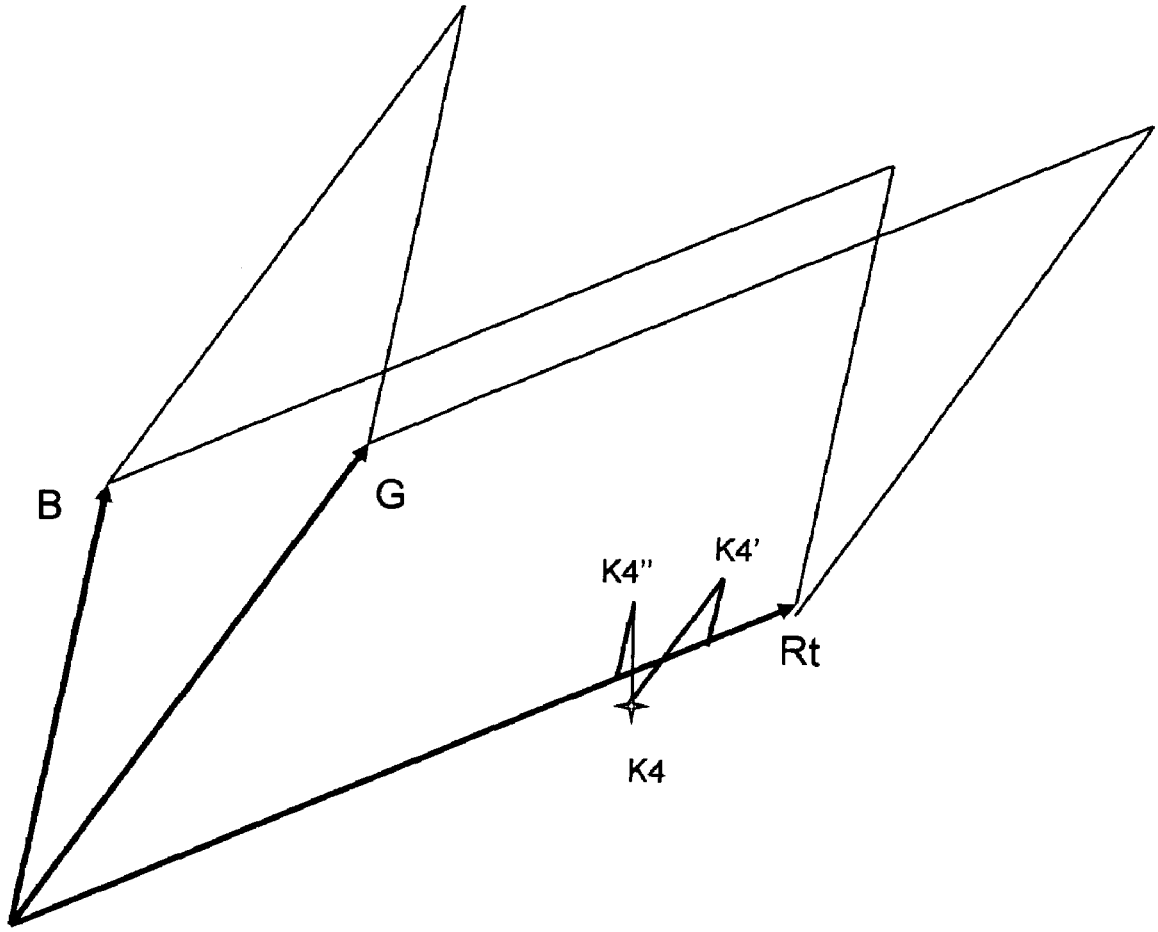
FIG. 5 illustrates an RGB colour space, and a method according to an embodiment of the present invention to represent a colour falling outside that colour space by primaries defining that colour space.

According to an aspect of the present invention, instead of simply setting the negative stimulus values to zero, the non-representable colour K4 is projected orthogonally on the plane span by the two primary colours which would get positive stimulus values when trying to represent colour K4. This means that not only the negative stimulus value is set to zero, but also that the other stimulus values are, or may be, amended. This is illustrated in FIG. 5, illustrating the colour space span by the three real or virtual primaries R, G and B. FIG. 5 is drawn in the tri-stimulus X, Y, Z co-ordinate system. In FIG. 5, colour K4 cannot be represented by the real or virtual primaries R, G, B, as K4 would have a negative drive stimulus value for the G primary. When setting the negative stimulus value at zero, a colour corresponding to K4' would be obtained, which corresponds to drive stimulus values for R and B which are the same as for representing K4. According to the present invention, by orthogonally projecting the non-representable colour K4 onto the plane span by B, and R, a colour corresponding to K4" is obtained, which corresponds to drive stimulus values for R and B which may be different from the ones originally calculated when trying to represent colour K4. It can easily be seen from FIG. 5 that at least the drive stimulus value for primary R is different from the one originally calculated.

Carrying out an orthogonal projection of the colour onto the plane may be done by a vector product. For example, for projecting a colour $\overline{T}$ on the plane span by $\overline{B}$ and $\overline{G}$, the following is calculated:

$$\overline{B}\times\overline{G}=\overline{T}$$

Then $\overline{T}$ is set to zero. By doing this, the colour is achieved which is closest to the colour one wants to display.

It is an advantage of the above method according to the present invention for representing colours which fall outside the colour gamut triangle of a pixel, that these colours, when effectively represented within the colour gamut, are represented with a colour lying closer to the actually desired but non-representable colour than in prior art methods.

Figure 6A:
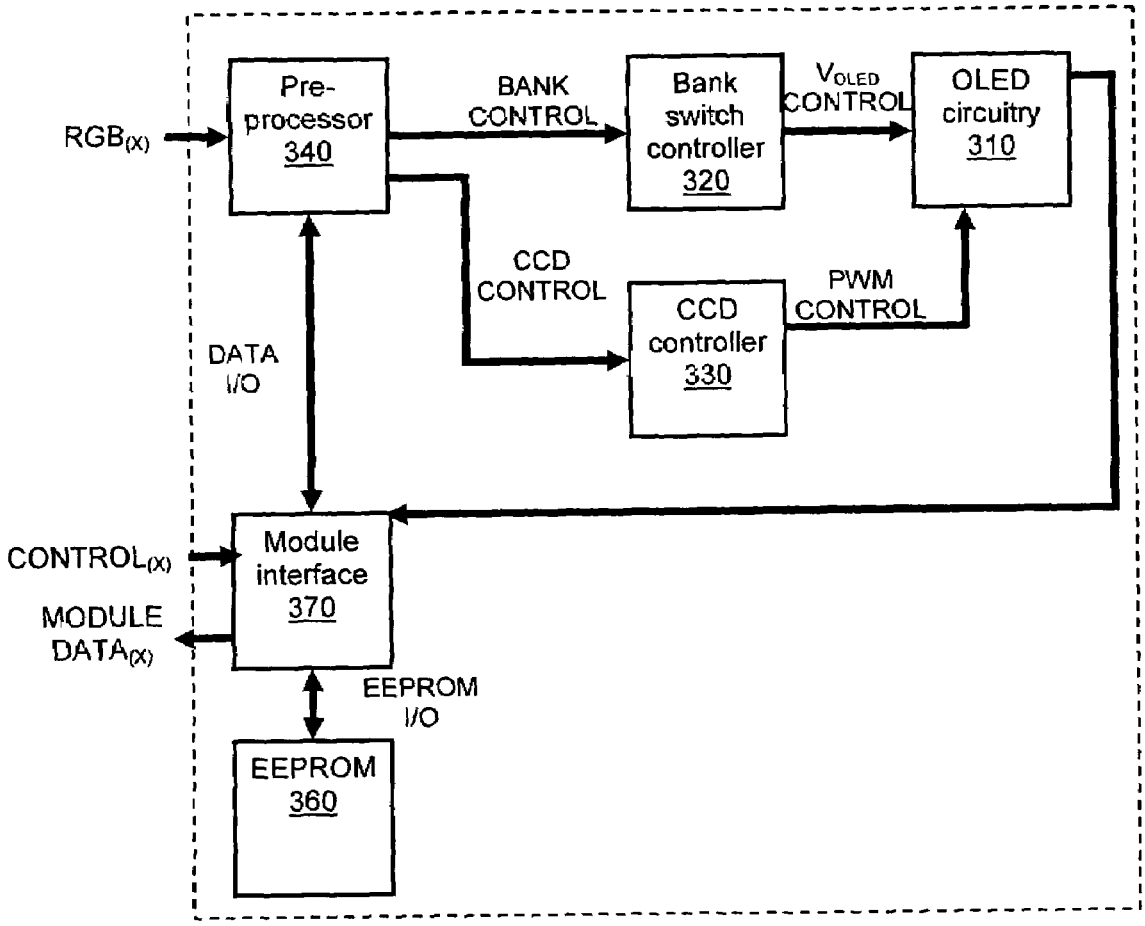
FIG. 6A illustrates a simplified version of a functional block diagram of an OLED module processing system implementing the color calibration algorithm of the present invention suitable for use in a large-screen display.

The color calibration algorithm of the present invention may be implemented using an OLED module processing system (suitable for use in a large-screen OLED display), of which a simplified functional block diagram with only the relevant components is shown in FIG. 6A. Color co-ordinates of each OLED device within the OLED circuitry are stored in EEPROM 360 in the form of (x y Y), where x and y are the color co-ordinates of the primary emitters and Y is defined as the brightness. Other information may be stored in EEPROM 360 at any time without deviating from the spirit and scope of the present invention. Communication to EEPROM is accomplished via EEPROM I/O bus.

EEPROM 360 is any type of electronically erasable storage medium. EEPROM 360 also stores the most recently calculated color correction values used for a preceding video frame.

OLED circuitry 310 includes a plurality of OLED devices having associated drive circuitry, which includes positive voltage sources, constant current drivers, and several active switches. The bank switches connecting the positive voltage sources to the rows of the OLED array within OLED circuitry are controlled by the VOLED CONTROL bus of bank switch controller 320. The active switches connecting the constant current drivers to the columns of the OLED array within OLED circuitry are controlled by the PWM CONTROL bus of CCD controller 330.

Module interface 370 collects, among other things, the current color co-ordinate information (tri-stimulus values in the form of x,y,Y) from EEPROM 360 for each OLED device within OLED circuitry 310. Module interface 370 also receives control data, i.e. CONTROL(X) bus, from a tile processing system that dictates to pre-processor 340 how to perform color correction for the current video frame.

Pre-processor 340 develops, among other things, local color correction for the current video frame using information from module interface 370. Pre-processor 340 combines the RGB data of the RGB(X) signal describing the current frame of video to display with the newly developed color correction algorithms and produces digital control signals, i.e., BANK CONTROL and CCD CONTROL bus, respectively, for bank switch controller 320 and CCD controller 330. These signals dictate exactly which OLED devices within OLED circuitry 310 to illuminate and at what intensity and color in order to produce the desired frame at the required resolution and color-corrected levels.

CCD controller 330 converts data from pre-processor 340 into PWM signals, i.e., PWM CONTROL bus, to drive the current sources that deliver varying amounts of current to the OLED array within OLED circuitry 310. The width of each pulse within PWM CONTROL bus dictates the amount of time a current source associated with a given OLED device will be activated and deliver current. Additionally, CCD controller 330 sends information to each current source regarding the amount of current to drive. The amount of current that each CCD drives is determined by pre-processor 340 based on color correction algorithms and the RGB(X) signal.

Bank switch controller 320 receives bank control data i.e., BANK CONTROL bus, from pre-processor 340 and transmits this control data via the VOLED CONTROL bus to the corresponding OLEDs.

The colour calibration algorithm according to the present invention can be used in modular displays as well as in fixed size displays. The explanation below is given for the case of a modular display. For a fixed size display, the explanation can be modified to the case were there is only one software level. The colour calibration algorithm may be implemented using a high-level software control system as described in the co-pending patent application of the applicant, entitled "Control system for a tiled large-screen emissive display".

Figure 6B:
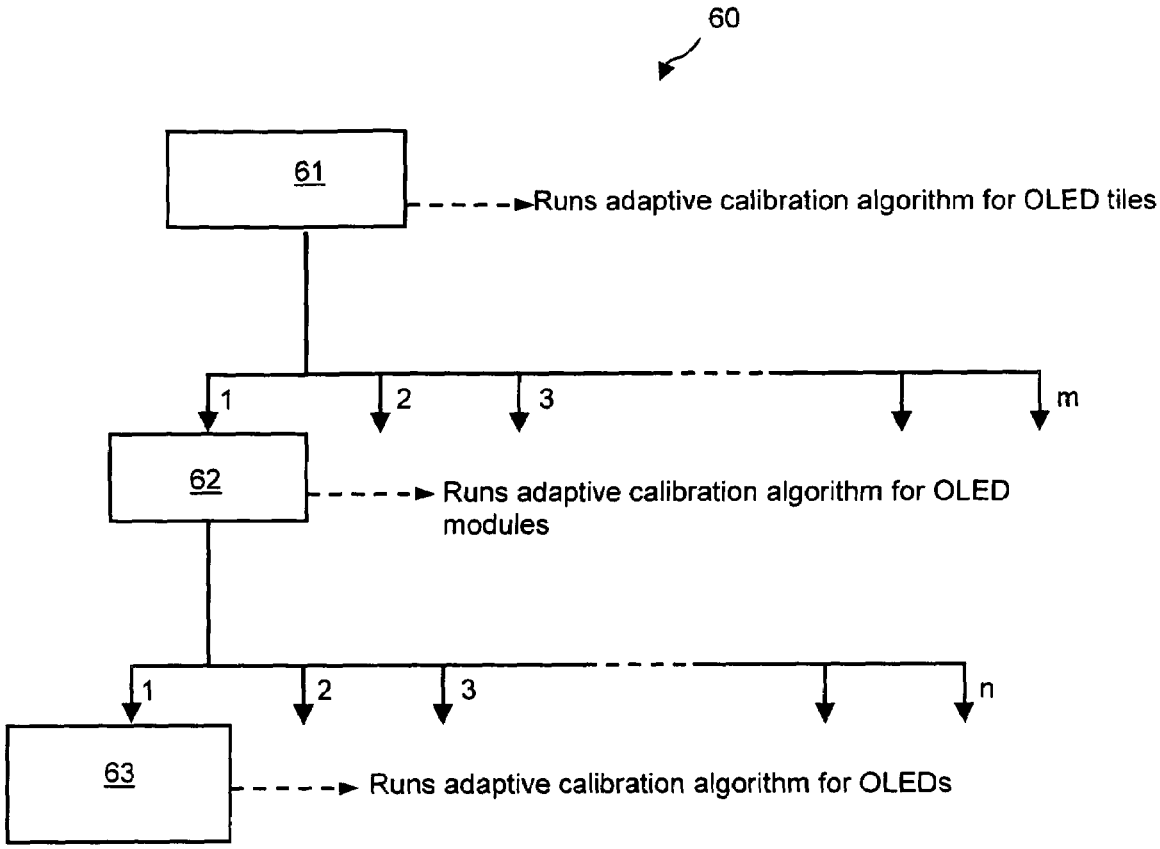
FIG. 6B illustrates a functional block diagram of an emissive display software system in accordance with the present invention.

FIG. 6B illustrates a functional block diagram of an (O)LED display software system 60. The (O)LED display software system 60 represented includes a system software component 61, a tile software component 62, and a module software component 63. The (O)LED display software system 60 provides the overall software control for a modular large-screen (O)LED display system. The system software component 61 is representative of the top level of software control, the tile software component 62 is representative of an intermediate level of software control, and the module software component 63 is representative of a low level of software control. In operation, information is passed among all levels and specific operations are distributed accordingly under the control of system software component 61. More specifically, and with reference to FIG. 6B: As the top-level controller, system software component 61 runs (among other things) adaptive calibration algorithms for (O)LED tiles.

As the mid-level controller, tile software component 62 runs (among other things) adaptive calibration algorithms for (O)LED modules.

As the low-level controller, module software component 63 runs (among other things) adaptive calibration algorithms for individual (O)LED devices or pixels. In general, the calibration algorithm is basically the same at all levels of the (O)LED display software system 60. This algorithm is executed by the tile software component 62 and/or the module software component 63, but decisions or information gathering is typically performed at the top level of system software component 61 by passing values from one level to the next. Thus, a cluster of (O)LED devices, a cluster of (O)LED modules, and a cluster of (O)LED tiles are calibrated in the same way via (O)LED display software system 60.

For example, a uniform output across all (O)LED devices within a given (O)LED module is ensured via an adaptive calibration algorithm, but that does not mean that a uniform output across all (O)LED modules within a given (O)LED tile is ensured. Subsequently, once (O)LED modules are uniform within themselves, all (O)LED modules outputs must further be uniform with their neighbours within each (O)LED tile. Likewise, once (O)LED tiles are uniform within themselves, all (O)LED tiles outputs must further be uniform with their neighbours within each (O)LED sub-display of display wall. Using the adaptive calibration algorithm the same algorithm is run at all levels from the lowest to the highest as follows:

1) The adaptive calibration algorithm of the module software component 63 reads the x,y,Y light outputs and colour co-ordinates for every (O)LED device for each (O)LED module. The optimal target x,y,Y co-ordinates are subsequently calculated. Values are then passed on to the next higher level, i.e., to tile software component 62.
2) The adaptive calibration algorithm of the tile software component 62 reads the optimal target x,y,Y light outputs and colour co-ordinates of each (O)LED module for each (O)LED tile. The optimal target x,y,Y co-ordinates are subsequently calculated. Values are then passed on to the next higher level, i.e., to the system software component 61.
3) The adaptive calibration algorithm of the system software component 61 reads and calibrates every (O)LED tile for each (O)LED sub-display of the display wall. Each (O)LED sub-display is subsequently calibrated to the optimal target (O)LED sub-display of display wall x,y,Y co-ordinates. In this way, a uniform image is ensured throughout the entire display wall.

It is to be understood that although preferred embodiments, specific constructions and configurations, as well as materials, have been discussed herein for devices according to the present invention, various changes or modifications in form and detail may be made without departing from the scope and spirit of this invention.

The invention claimed is:

1. A calibration method for calibrating a fixed format emissive display device having a plurality of pixels, each pixel comprising at least three sub-pixels for emitting light of different real primary colors, the method comprising:

determining, for each real primary color separately, a virtual target primary color, determining a color gamut defined by the determined virtual target primary colors, adjusting the drive currents to the sub-pixels to achieve a color inside the determined color gamut, and determining a target luminance for each virtual target primary such that the target luminance is set equal to the maximal luminance that can be achieved by all or substantially all of the real primaries able to realize the target luminance of the corresponding virtual primary wherein determining the color co-ordinates of a virtual target primary color comprises determining a center of gravity of a cloud formed by the color co-ordinates of the corresponding real primary colors of all pixels of the display device.

2. The calibration method of claim 1, wherein the color co-ordinates determined for a virtual target primary color differ from the color coordinates of the centre of gravity of a cloud by up to 20%.

3. The calibration method of claim 1, furthermore comprising determining a center of gravity line of a cloud formed by the color co-ordinates of the real primary colors of all pixels of the display device corresponding to the virtual target primary color to be determined.

4. The calibration method of claim 3, furthermore comprising chosing the color co-ordinates of the virtual target primary color on the center of gravity line or within a deviation of at most 20% of the value of the color coordinates of a point located on the center of gravity line.

5. The calibration method of claim 1, including determining a virtual target primary color that all the sub-pixels of the display device are able to achieve.

6. The calibration method according to claim 5, wherein the determination of the target luminance of a virtual target primary color depends on the application in which the display device is to be used.

7. The calibration method according to claim 5, wherein the target luminance of the virtual target primaries is selected so as to provide improved brightness uniformity.

8. The calibration method according to claim 5, wherein the target luminance of the virtual target primaries is selected so as to provide a higher absolute brightness value.

9. The calibration method according to claim 5, wherein determining the target luminance of the virtual target primary colors is performed after virtual target primary colors have been determined a first time.

10. The calibration method of claim 1, including determining a color gamut that all the sub-pixels of the display device are able to achieve.

11. The calibration method of claim 1, wherein linear combinations of the virtual target primary colors are used to form the color gamut.

12. The calibration method of claim 1, wherein determining, for each primary color separately, the color co-ordinates of a virtual target primary color, depends on the application in which the display device is used.

13. The calibration method according to claim 12, wherein the virtual target primary colors are determined so as to give better results with respect to color saturation than with respect to color uniformity.

14. The calibration method according to claim 12, wherein the virtual target primary colors are determined so as to give better results with respect to color uniformity than with respect to color saturation.

15. The calibration method according to claim 1, wherein determining, for each primary color separately, the color coordinates of the virtual target primary color is performed after virtual target primary colors have been determined a first time.

16. The calibration method according to claim 1 wherein the number of virtual target primary colors equals the number of real primary colors.

17. The calibration method of claim 1, wherein adjusting the drive current to the sub-pixels to achieve a color inside the determined color gamut comprises adjusting the drive current, not only of a first real primary color which would have a negative drive stimulus value, but also of at least one other real primary color which has a positive drive stimulus value.

18. The calibration method of claim 17, wherein adjusting the drive currents of the first real primary color and the at least one other real primary color is such that the color to be achieved inside the determined color gamut is projected orthogonally on a plane in a stimulus co-ordinate system, which plane is spanned by stimulus co-ordinates of two real primary colors which would not have a negative drive stimulus.

19. A fixed format emissive display device calibrated in accordance with claim 1.

* * * * *